United States Patent [19]

Hanerus et al.

[11] Patent Number: 5,009,339

[45] Date of Patent: Apr. 23, 1991

[54] METHOD OF AND AN APPARATUS FOR VENTING A FILLING PLANT

[75] Inventors: Goran Hanerus, Malmo; Tommy Ljungstrom, Hoor, both of Sweden

[73] Assignee: Tetra Pak Holdings & Finance S.A., Switzerland

[21] Appl. No.: 422,683

[22] Filed: Oct. 17, 1989

[51] Int. Cl.[5] ..... B67C 3/22; B65B 31/00

[52] U.S. Cl. ..... 222/1; 222/152; 222/380; 141/258; 141/285

[58] Field of Search ..... 222/1, 152, 380; 141/258, 260, 261, 285

[56] References Cited

U.S. PATENT DOCUMENTS

| | | | |
|---|---|---|---|
| 4,299,338 | 11/1981 | Jain et al. | 222/152 |
| 4,437,498 | 3/1984 | Pankratz et al. | 222/380 |
| 4,467,846 | 8/1984 | Croser | 141/285 |
| 4,723,581 | 2/1988 | Staudenrausch et al. | 141/258 |
| 4,798,235 | 1/1989 | Torterotot | 141/258 |
| 4,905,744 | 3/1990 | Siegrest et al. | 141/261 |
| 4,924,058 | 5/1990 | Johner | 222/152 |

FOREIGN PATENT DOCUMENTS

| | | |
|---|---|---|
| 3622807 | 1/1988 | Fed. Rep. of Germany . |
| 2160182 | 12/1985 | United Kingdom . |

*Primary Examiner*—Andres Kashnikow
*Assistant Examiner*—Karen B. Merritt
*Attorney, Agent, or Firm*—Paul & Paul

[57] ABSTRACT

A method of venting a plant for filling containers (2) with an apportioned quantity of liquid without air inclusions by means of a dispensing pump (9) in which two control valves (11', 12') disposed at the outlet from a filler pipe (4) are intermittently opened and closed, the liquid (17) being supplied via a buffer container (13). To avoid faulty filling at the start of the filling operation during the forward run of product, and in order to be able as far as possible to determine an exact switch-on time for the actual filling process, it is according to the invention envisaged that for venting the filler pipe (4) and the dispensing pump (9) connected thereto, two serially connected control valves (11',12') are so controlled separately from each other that upon creation of the vacuum in the buffer container (13) both control valves (11', 12') are opened; after the major part of the air has bubbled out upwardly, firstly the upper control valve (12') and after an adjustable period the lower control valve (22') are closed after which the upper control valve (12') is opened and closed again after a further interval of time.

8 Claims, 2 Drawing Sheets

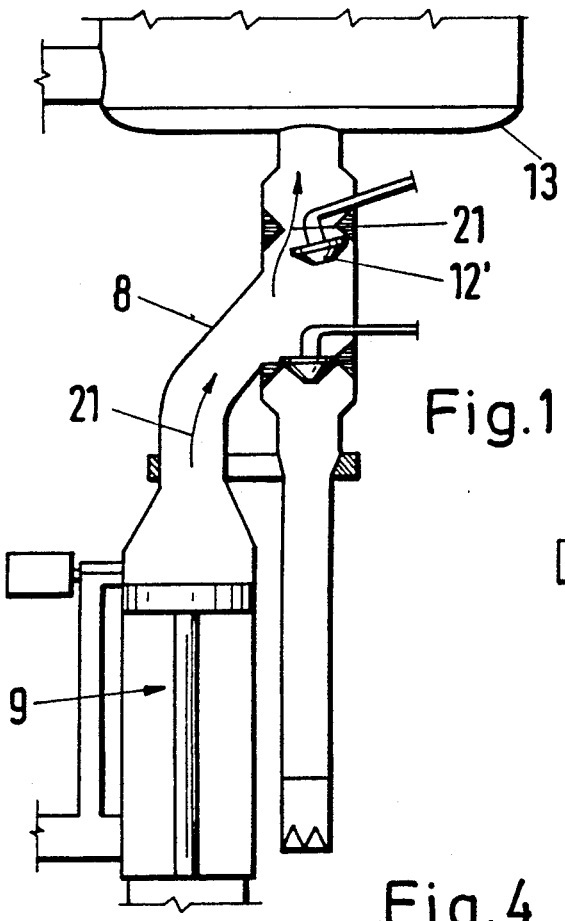
Fig.1
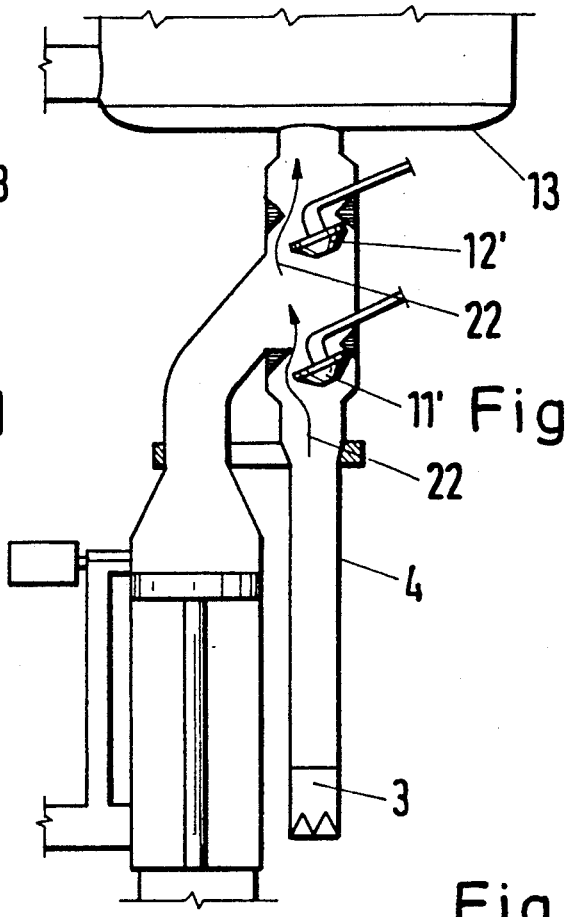
Fig.2
Fig.4
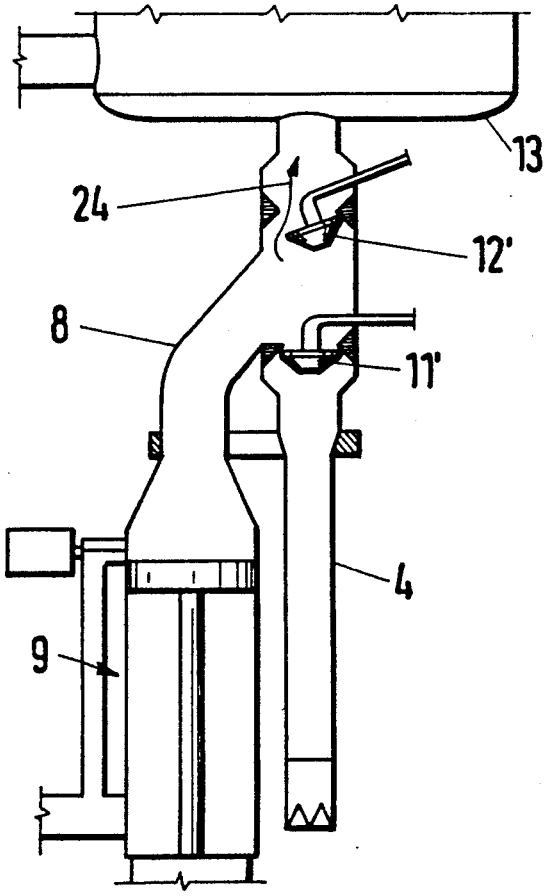
Fig.3
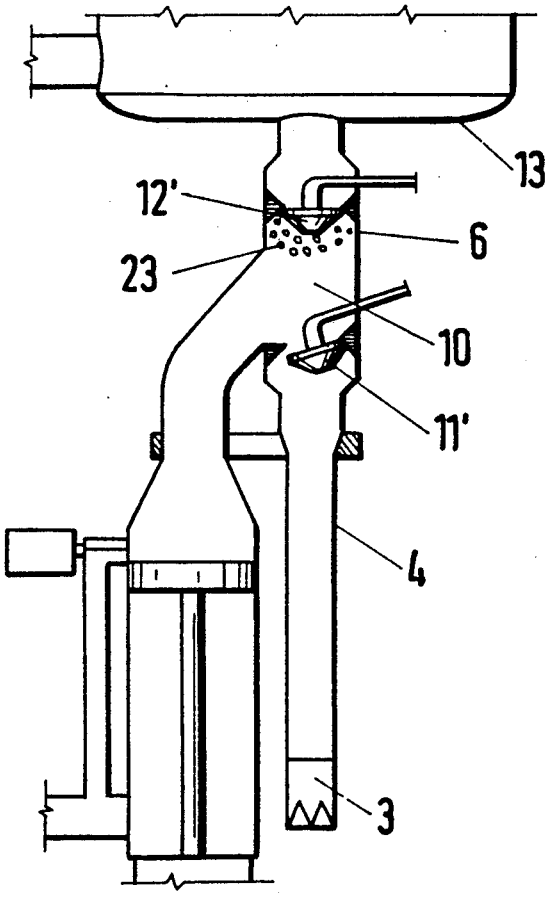

METHOD OF AND AN APPARATUS FOR VENTING A FILLING PLANT

BACKGROUND OF THE INVENTION

The invention relates to a method of venting a plant for filling containers with an apportioned quantity of liquid without the inclusion of air, by means of a dispensing pump in which at least one control valve disposed at the entrance to the filling pipe is intermittently opened and closed, the liquid being supplied via a buffer container. Furthermore, the invention relates to an apparatus for venting such a plant for filling containers with an apportioned quantity of liquid without the inclusion of air, and this apparatus comprises, connected to a feed pipe, a buffer container under which there is a control valve housing with at least one control valve which closes the intake side of a filler pipe disposed underneath it and closable at the outlet by a filling nozzle, or connects the said inlet side to the buffer container.

In the case of packaging means for liquids, the main body of which consists of an open-topped tube, a plant is known for filling such containers with a dispensed quantity of liquid, without the inclusion of air, such liquid being for instance milk. Filling without the inclusion of air however presupposes various measures, particularly venting at the commencement of the filling operation if for instance there has been a change-over to another type of container or to a different type of contents. In the prior art case, milk from a central distributing point is fed via a feed pipe to the buffer container and, controlled by valves, is passed into a filler pipe disposed under the valves and at the outlet from which the tubular milk container is disposed and is to be filled. It is possible for air to collect in this filler pipe and the aim of the invention therefore is to provide measures in order to remove this air.

At the start of the entire filling process, enclosed air is present at the various parts of the plant and when pumping and filling of the packaging means commence, this air is necessarily conveyed into the containers. The desire is to avoid this.

In the case of prior art filling plants, therefore, in the case of milk, 10 containers are filled during the forward run with milk from those parts of the plant in which there are pockets of air, so that the containers are not completely filled. Therefore, they are treated as rejects. If a product of a thicker consistency such as for example yoghurt, is being filled into the containers, then for the forward run of a filling operation, generally 25 filled containers are rejected because from experience it is assumed that after the 25th container has gone through, no further air is likely to be enclosed in the containers.

In the production condition, all pipes in the system should be completely bereft of air and filled only with intended contents, so that the packaging means can actually be filled with the apportioned quantity. Generally, the prior art dispensing pumps have one piston, the pump travel of which determines the dispensed quantity of liquid which is to be filled into the container.

For a dairy or some other filling company in which liquids have to be filled into a large number of packaging means of different contents or where such containers have to be filled with different materials, it will be understood that every time before production commences or after the plant has been changed over, it is undesirable to have to turn out rejects purely in order to vent the plant.

Therefore, the invention is based on the problem of providing a method for venting such a plant having the features mentioned at the outset, in which incorrect filling of the forward run of production material at the start of the filling process is avoided; it is furthermore intended that it be possible to pre-set an accurate switch-on time for the actual filling process, at which it is ensured that there is no longer any air present in the plant.

The problem also applies to the improvement of an apparatus for venting such a plant having the aforementioned features, which makes it possible to determine an accurately timed venting procedure, after which the work of filling can preferably be started by simply pressing a button at a point in time at which the operator can with justification expect the plant no longer to include any air.

With regard to the method, this problem is resolved in that a vacuum is generated in the filler pipe which has a filling jet at the outlet end and also in the buffer container, by closing the filling jet, the control valve being opened, and in that after the air has bubbled out and upwards, the control valve is closed after an adjustable time lapse. A man skilled in the art will understand that when a vacuum is applied to the space above the surface of liquid in a buffer container any inclusions of air in the buffer container or in parts of the plant below it will be able to bubble out or will acquire greater buoyancy than without a vacuum. Indeed, air inclusions are usually, in course of time, forced upwards by vibration or such like but due to curvature in the piping system and the like, it can generally take a relatively long time for all the included air to be reliably eliminated. When filling starts, it is desirable to take the shortest possible time to expel all included air. By creating the vacuum, this can be achieved surprisingly well and easily. If the filler pipe is closed at the top by the aforesaid control valve, then for venting purposes the control valve is opened, so that any liquid present in the filler pipe can be retained while at the same time any air enclosed therein can rise and escape upwardly. After a time lapse, this control valve is closed and any other jobs including venting can be carried out and then production can start. This time lapse will be adjusted according to experience and the work will be carried out by qualified experts. For the same plant and the same contents, then, the same time lapse can be adjusted so that upon conclusion of development work for the new venting process, it will be possible to have recourse to these empirical values without every filling operation requiring the fresh attention of a qualified expert in order to adjust the time lapse.

Since the filler pipe with the filler jet is closed at the outlet end, the venting process can according to the invention be carried out without filling any packaging means so achieving a considerable saving in terms of reject material.

The use of vacuum in filling plants is known already per se in other connections. For example, there is already a device available for the intermittent feed of liquid, with a drip-free valve, the liquid being fed to a buffer container underneath the valve. Means provide for the generation of a vacuum in the buffer container. However, the purpose of this vacuum is to reduce in the portion of pipe with the valves the hydrostatic pressure which the liquid would otherwise create at the valves.

By reason of the vacuum, the restoring springs of the valves can be so adjusted that they always close or open at the right moment, which is particularly important when the material being filled into the containers is milk which can foam. For ventilating the filling plant, the vacuum provided for in accordance with this known method cannot however be used. Furthermore, it has been found that the response of spring-loaded valves is too greatly delayed.

According to the invention, on the other hand, it is particularly expedient if for venting the filler pipe and the dispensing pump connected to it, two serially connected control valves are so operated separately from each other that upon creation of the vacuum in the buffer container, both control valves are opened; after the major part of the air has bubbled out upwardly, first the upper control valve is closed, followed by the bottom control valve which is closed after an adjustable time lapse; then the upper control valve can be opened and closed again after another period of time. If it is intended to vent a plurality of parts of the plant by the method according to the invention, then a plurality of control valves should be disposed separately from one another and actuated in the manner described. In the case of a preferred filling plant, in addition to the filler pipe, there is also the dispensing pump connected in the same area of the plant, in other words two branches in the system which have to be vented, which is why the two control valves are disposed separately from each other and are separately actuated. In this way, in fact, it is possible firstly to vent one branch and when this has been closed off in a clean condition, the other branch of the plant can be vented.

Furthermore, according to the invention, it is expedient if firstly the vacuum is generated in the buffer container, the bottom control valve is closed and the upper control valve is opened; then, both valves should be opened simultaneously, whereupon the upper valve should be closed and the lower one closed, the upper valve opened and finally the upper control valve should be closed again, while the filler nozzle remains closed the whole time. With such a method, air inclusions can be reliably eliminated after a certain time so that a certain programme with rigidly adjusted time intervals is completed and upon its conclusion it is possible automatically to signal the readiness of the plant to be started. Even unskilled operating personnel can then set the filling process in motion by simple pressure of a button. However, this means an automated venting with no wastage. Also, there is a saving on the employment of skilled operators who by experience with conventional venting of such filling machines only have to estimate when it is probable that there are no longer any air pockets in the plant. This automation of the filling process or of the upstream venting process is simple, is not susceptible to breakdown and makes it possible to save on personnel in the general part of the user's plant.

The venting method of this type is already very well thought out but can be improved in terms of one further detail. For example, taking as a premise a filler pipe which is closed at the outlet end by a filler nozzle, and on the assumption that there is above the filler nozzle on the outlet side a column of liquid which has a specific weight. If inclusions of air are removed from this column of liquid by the method according to the invention, then one has to anticipate an increase in weight or an elevation of the liquid column, because the expelled air is replaced by liquid so that there is a greater weight acting on the filler nozzle at the outlet end. Therefore, according to the invention, it is advantageous if when first opening the bottom control valve the vacuum in the buffer container is increased. With the venting method according to the invention, air inclusions can be eliminated from the filler pipe via the filler nozzle at the outlet end as a result of the initial opening of the bottom control valve, so that at this point in time the increase in weight starts and is neutralised again by the increased vacuum.

This equalisation of the pressure force on the filler nozzle at the outlet end of the filler pipe due to the increased force of suction applied by the increased vacuum is in fact particularly expedient if a filler nozzle is used which closes as a result of negative pressure in the filler pipe. As a result of the increase in weight when the air inclusions are expelled, it could in fact otherwise happen that the filler nozzle would open partially because the closure force is no longer sufficient. This risk is excluded again by the intermediate step of increasing the vacuum in the buffer container and thus above the column of liquid in the filler pipe, this preventive measure being both advantageous and attainable by simple means.

In connection with the apparatus for venting the filling plant, the aforementioned problem is according to the invention resolved in that the control valve is positively controlled from without while the buffer container is connected to a vacuum pump. The positive control according to the invention acts firstly on the control valve and secondly on the drive of the vacuum pump so that both units, the control valve and the vacuum pump, develop their effects in the venting plant according to a specific programme. In the past, valves have generally been operated by the condition of the adjacent fluent medium, and in the case of liquids filling plants, it has been the pressure of the material inside the plant which had to overcome a spring force before the relevant valve provided with the spring could be operated. As a result of the positive control of the new valve in the venting device, not only is its functioning more reliable so that 100% closure can be assured after completion of the switch closure (the same applies to opening), but the switching function is also shortened because externally controlled valves can react more quickly.

As a result of the buffer container being connected to the vacuum pump, which can likewise be controlled within the framework of the programme, it is possible in the manner described hereinabove considerably to accelerate the expulsion of included air. As a result of the feature of the venting device according to the invention, therefore, it is possible to vent a filling plant in the shortest possible time, so that the operator of the filling plant can in an optimally short time bring the plant to normal operating status without air inclusions.

According to the invention, it is furthermore particularly advantageous to provide at a distance above the bottom control valve an upper control valve which is separately and positively operated by an external control, the connecting line from the dispensing pump being connected to the control valve housing between the upper and lower control valves. By this measure, it is possible to attain the mode of operation already mentioned above, namely and as desired to vent the dispensing pump disposed in one of two branches of the installation disposed underneath the buffer container independently of and/or simultaneously with the filler pipe.

According to the invention, it is furthermore expedient for the filler nozzle to consist of an elastomeric material. For example, it is possible to use a filler nozzle of rubber which in the closed state has two mutually cruciform slots which are kept closed by the negative pressure behind them and inside the filler pipe. In another connection, there are already such rubber nozzles which close when there is a negative pressure in the filler pipe. Such a rubber nozzle naturally tends to close which is why even a negligible negative pressure in the pipe above the rubber nozzle and in respect of the outside atmosphere is sufficient to close the nozzle or to keep it closed. With such a rubber nozzle, it is possible to maintain a column of liquid in a completely closed filler pipe above the closed nozzle without any danger of dripping. However, the use of such a rubber nozzle in a venting apparatus of the type described here has not so far been known.

In the case of a further advantageous development of the invention, if the control valves and/or the vacuum pump are connected to a computer control arrangement, then the above-described advantages of rapid and reliable ventilation can be achieved. It is currently the state of the art to feed simple or complicated programmes into a computer which can with great accuracy and at controlled times issue control signals so that the venting method described here can be carried out with great reliability under full control and in an accurately timed manner.

BRIEF DESCRIPTION OF THE DRAWINGS

Further advantages, features and possible applications of the present invention will emerge from the following description of a preferred example of embodiment, in conjunction with the accompanying drawings, in which:

FIG. 1 shows a diagrammatic and broken-away view of the essential parts of the venting apparatus according to the invention, in a first condition, FIGS. 2 to 4 show the same broken-away view as in FIG. 1 but showing the conditions 2 to 4 while

DESCRIPTION OF THE PREFERRED EMBODIMENT

Figure 5:
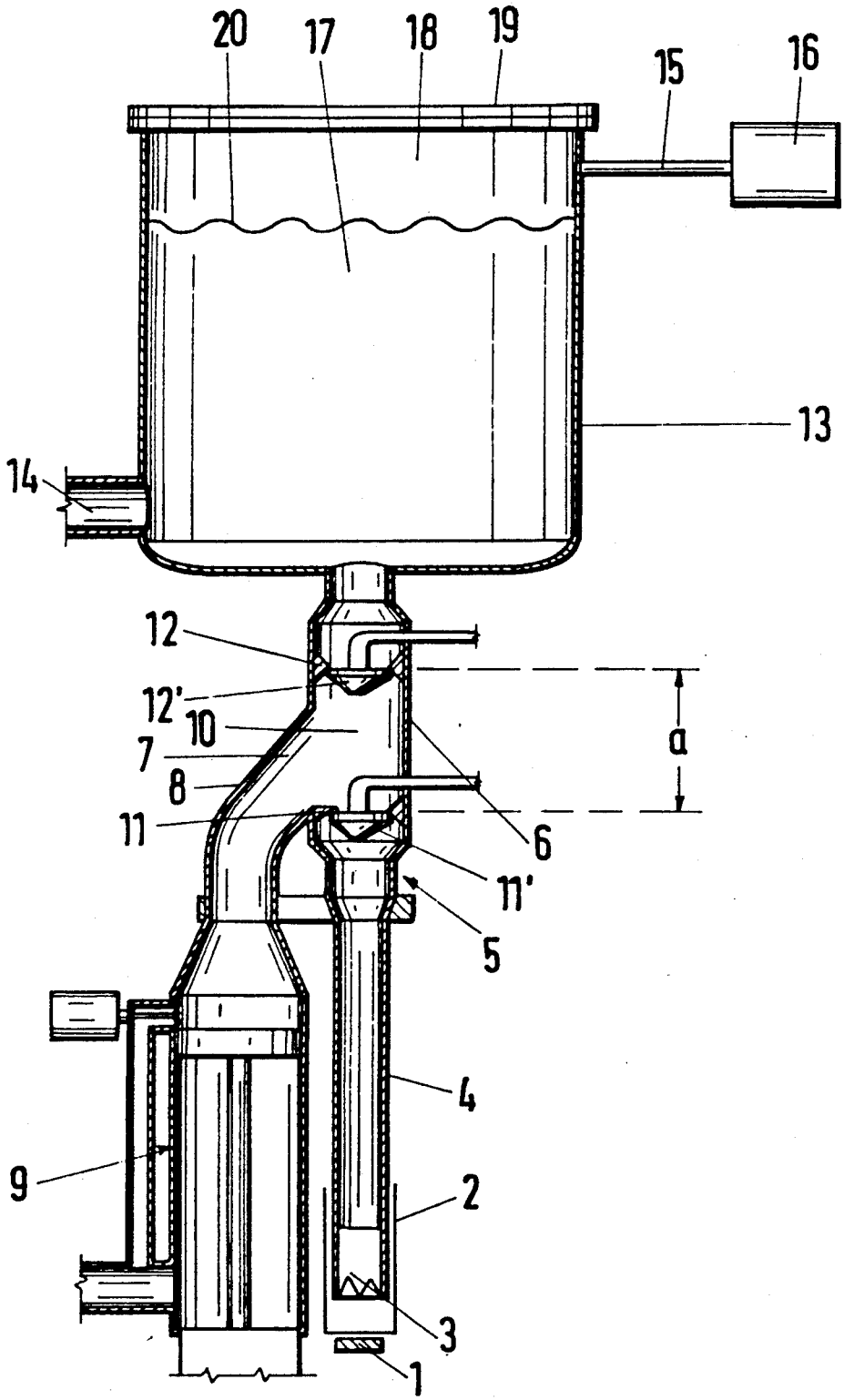
FIG. 5 is a more complete view of a part of a filling plant for filling a liquid into a series of packaging means disposed on a conveyor belt.

The general features can best be explained with reference to the view in FIG. 5 where there is on the diagrammatically shown conveyor belt 1 an open-topped liquids container 2 which engages around the bottom end of a filler pipe 4 closed by a rubber filler nozzle 3. In the situation shown in FIG. 5, the filler nozzle 3 is shown as substantially immersed in the packaging means 2. With a suitable plant for filling paper containers with a dispensed quantity of milk, it is possible to envisage a relative movement between the filler pipe 4 and the container 2 so that when the container is empty, the filler nozzle 3 moves to a position almost at the bottom of the container 2 carrying out the filling process while the filler pipe 4 is slowly withdrawn from the container 2. Since the filling process itself is not important to the explanation of the procedural steps and features of the apparatus which are of interest here, the foregoing description of the filling process will suffice.

Provided at the bottom inlet end 5 of the filler pipe which is opposite the outlet from the filler pipe 4, with the filler nozzle 3 is a control valve housing 6 connected at its top to the filler pipe and the said control valve housing 6 is of cylindrical construction having a lateral opening 7 from which is branched the connecting pipe 8 of a dispensing pump 9, the branch starting in fact from a space 10 above the seat 11 of the bottom control valve 11' and below the valve seat 12 of the upper control valve 12'. Both control valves 11' and 12' are shown closed in FIG. 5. Furthermore, they appear in sharply diagrammatic form with the actuating rods projecting out from the control valve housing 6 and which are intended purely to symbolise the positive control of the control valves 11', 12' from external sources.

Above the control valve housing 6 is a buffer container 13 which is provided on one side (here bottom left) with a feed pipe 14 and on the other side (here top right) with a vacuum pipe 15 and vacuum pump 16. The blank space 18 disposed above the undulating separating line 20 above the mass of liquid 17, with the gas-tightly closed lid 19 of the buffer container 13 constitutes the vacuum.

During operation, the venting apparatus with the two control valves 11' and 12' disposed at a distance a above each other operates as follows:

Let it be supposed that below the level 20 of the liquid 17 the entire installation including the dispensing pump 9 is at the start of a production run filled with the liquid which is to be transferred to containers. Enclosed air must now be expelled as follows. The buffer container 13 is evacuated by the vacuum pump 16 so that a first definite vacuum is created in the space 18. It will be appreciated that air enclosed above the closed upper control valve 12' is extracted by this vacuum and through the vacuum pipe 15. It is assumed thereby that the premise adopted is the status in FIG. 5, in which a partial vacuum is likewise created in the space of the filler pipe 4 and that this closes the filler nozzle 3.

The container 2 is no longer shown in the other drawings 1 to 4 and even the buffer container 13 is shown as being broken-away at the top. During the entire operation of venting, FIGS. 1 to 5 show the filler nozzle 3 as closed.

After the vacuum has been set up in the space 18, the plant is then switched over to the condition shown in FIG. 1, i.e. the upper control valve 12' is opened. Air pockets present in the region of the dispensing pump 9 can now escape upwardly in the direction of the arrows 21, passing into the buffer container 13. Also the column of liquid present above the piston of the dispensing pump 9 is subject to the vacuum shown. The first partial space, i.e. the left hand branch of the venting apparatus with the connecting pipe 8 is thus vented.

The next stage is to switch over to the condition in FIG. 2, i.e. also the bottom control valve 11' is opened. When this happens, the upper control valve 12' remains open. Air enclosed in the filler pipe 4 can now escape upwardly into the buffer container 13 as indicated by the arrows 22, the vacuum pump 16 possibly starting to operate in order to restore to the desired level the vacuum which has been diminished by incoming air.

Due to the opening of the lower control valve 11', the column of liquid in the filler pipe 4 becomes greater and furthermore due to the additional liquid which replaces the escaping air, it becomes heavier. So that the filler nozzle 3 remains closed and as a compensation for this increase in weight, a special part of the computer programme provides for the vacuum pump 16 to be switched on in order to raise the level of the vacuum in the space 18 to a higher level. Consequently, the filler nozzle 3 of rubber remains closed even though, with indeed drip-free sealing tightness, the induction of small quantities of gas (air) from below and into the filler pipe 4 cannot be entirely avoided. Also this air which has bubbled in from below moves upwardly following the path indicated by the arrow 22.

If, then, the plant is switched to the condition shown in FIG. 3 in that the upper control valve 12' is closed, then two things happen; firstly, the high column of liquid is reduced from the line 20 downwards to the filling nozzle 3 because the part of the column of liquid which is above the upper control valve 12' is cut off and furthermore there is a negligible reduction in vacuum in the filler pipe 4 so that the induction of ultra-fine air bubbles from the atmosphere into the filler nozzle 3 from below ceases. It is now necessary to wait until these indrawn air bubbles resulting from the time when the upper control valve 12' was still open, have risen upwardly into the space 10 inside the control valve housing 6 so that they collect in the manner shown at 23 at the top of FIG. 3. Now the bottom control valve 11' is likewise closed and it can be assumed that the liquid in the filler pipe 4 is perfectly vented from the filler nozzle 3 as far as the bottom control valve 11'.

The air which has accumulated at 23 is then eliminated from the plant in that this latter is switched to the condition shown in FIG. 4.

This means that with the bottom control valve 11' closed, the upper control valve 12' is opened so that included air can be eliminated by passing upwardly as indicated by the arrow 24 into the buffer container 13. It can now be rightly and with experience assumed that also the left hand branch with the connecting pipe 8 and the dispensing pump 9 has been just as perfectly vented as has the filler pipe 4. Therefore, after a specific time lapse, the upper control valve 12' can be closed so restoring the condition shown in FIG. 5.

The venting process is thus completed and the process of filling by means of the dispensing pump 9 can commence, contents being filled into containers 2 without any included air.

We claim:

1. A method of venting a plant for filling containers by means of a dispensing pump with an apportioned quantity of liquid without the inclusion of air, the liquid being supplied via a buffer container to a filler pipe having a control valve disposed at the intake thereof and which is provided at its outlet end with a filler nozzle, comprising the steps of (1) creating a vacuum in the filler pipe and within the buffer container while closing the filler nozzle, (2) maintaining the control valve open, (3) allowing air to bubble out upwardly, and then (4) closing the control valve.

2. A method of venting a plant for filling containers by means of a dispensing pump with an apportioned quantity of liquid without the inclusion of air, the liquid being supplied via a buffer container through serially connected bottom and upper control valves to a filler pipe connected to the dispensing pump, the bottom control valve disposed at the intake of the filler pipe, the filler pipe being provided at its outlet end with a filler nozzle, comprising the steps of (1) maintaining the bottom and upper control valves open, (2) creating a vacuum within the buffer container, (3) allow air to bubble out upwardly, (4) close the upper control valve, (5) after a delay, close the bottom control valve, (6) open the upper control valve, (7) after a delay, close the upper control valve.

3. A method of venting a plant for filling containers by means of a dispensing pump with an apportioned quantity of liquid without the inclusion of air, the liquid being supplied via a buffer container through serially connected bottom and upper control valves to a filler pipe connected to the dispensing pump, the bottom control valve disposed at the intake of the filler pipe, the filler pipe being provided at its outlet end with a filler nozzle, comprising the steps of (1) creating a vacuum within the buffer container, while maintaining the bottom control valve closed and the upper control valve open, (2) open the bottom control valve, (3) close the upper control valve, (4) close the bottom control valve, (5) open the upper control valve, (6) close the upper control valve, while the filler nozzle remains closed.

4. A method according to claim 3 wherein the vacuum in the buffer container is increased during step (2).

5. An apparatus for venting a plant for filling containers with an apportioned quantity of liquid without any air inclusion, comprising in combination a dispensing pump, a buffer container connected to a feed line and a vacuum pump, a filler pipe adapted to have its outlet closed by a filler nozzle, a control valve housing with an upper externally and separately positively controlled control valve which connects to the buffer container and a bottom externally and separately positively controlled control valve which occludes the intake end of the filler pipe.

6. An apparatus according to claim 5, wherein there is provided a connecting line from the dispensing pump into the control valve housing between the upper control valve and the lower control valve.

7. An apparatus according to claim 5 or 6, wherein said filler nozzle consists of an elastomeric material.

8. An apparatus according to claim 5 or 6 wherein either the bottom control valve and the upper control valve or the vacuum pump are computer controlled.

* * * * *